US005951271A

United States Patent [19]

DuMoulin et al.

[11] Patent Number: 5,951,271

[45] Date of Patent: Sep. 14, 1999

[54] STABILIZATION RING AND SEAL CLEARANCE FOR A SCROLL COMPRESSOR

[75] Inventors: Terrence R. DuMoulin, Monroe; Brian J. Gram, Dundee, both of Mich.

[73] Assignee: Tecumseh Products Company, Tecumseh, Mich.

[21] Appl. No.: 08/828,222

[22] Filed: Mar. 24, 1997

[51] Int. Cl.[6] ..... F04C 18/04; F04C 27/00

[52] U.S. Cl. ..... 418/55.3; 418/55.4; 418/55.5; 418/57

[58] Field of Search ..... 418/55.3, 55.4, 418/55.5, 57

[56] References Cited

U.S. PATENT DOCUMENTS

| | | | |
|---|---|---|---|
| 4,160,629 | 7/1979 | Hidden et al. | 418/55.3 |
| 4,435,137 | 3/1984 | Terauchi | 418/57 |
| 4,522,575 | 6/1985 | Tischer et al. | 418/55.5 |
| 4,674,963 | 6/1987 | Morishita et al. | 418/83 |
| 4,696,630 | 9/1987 | Sakata et al. | 418/57 |
| 4,743,181 | 5/1988 | Murayama et al. | 418/55.4 |
| 4,810,176 | 3/1989 | Suefuji et al. | 418/55.3 |
| 4,928,503 | 5/1990 | Riffe | 418/55.4 |
| 5,108,274 | 4/1992 | Kakuda et al. | 418/55.1 |
| 5,131,828 | 7/1992 | Richardson, Jr. et al. | 418/55.3 |
| 5,152,682 | 10/1992 | Morozumi et al. | 418/55.1 |
| 5,167,494 | 12/1992 | Inagaki et al. | 418/55.3 |
| 5,211,550 | 5/1993 | Kawabe | 418/55.3 |
| 5,383,772 | 1/1995 | Richardson, Jr. et al. | 418/55.4 |
| 5,413,469 | 5/1995 | Nakajima et al. | 418/55.1 |
| 5,427,513 | 6/1995 | Yamada et al. | 418/55.2 |
| 5,468,130 | 11/1995 | Yamada et al. | 418/55.2 |
| 5,470,213 | 11/1995 | Iguchi et al. | 418/55.2 |

FOREIGN PATENT DOCUMENTS

| | | | |
|---|---|---|---|
| 2-277985 | 11/1990 | Japan . | |
| 2-308990 | 12/1990 | Japan . | |
| 4-101090 | 4/1992 | Japan | 418/55.3 |
| 4-303191 | 10/1992 | Japan | 418/55.3 |
| 6-167284 | 6/1994 | Japan | 418/55.3 |

*Primary Examiner*—John J. Vrablik
*Attorney, Agent, or Firm*—Baker & Daniels

[57] ABSTRACT

An axial compliance mechanism for a scroll-type compressor including a fixed scroll member, an orbiting scroll member and a bearing pad spatially fixed in relationship to the fixed scroll member. The axial compliance mechanism biases the orbiting scroll towards the fixed scroll by applying a fluid at high pressure to a radially inner portion of the back surface of the orbiting scroll member and a relatively lower pressure to a radially outer portion of the back surface. An annular stabilization ring is placed between a main bearing pad and the rear surface of the orbiting scroll lifting the orbiting scroll into engagement with the fixed scroll and inhibiting the tilting and wobbling of the orbiting scroll. The annular stabilization ring also maintains a clearance between the rear surface of the orbiting scroll and the main bearing pad thereby improving the performance of a sealing member disposed between the main bearing pad and the rear surface of the orbiting scroll member during start up of the compressor. The annular stabilization ring lifting the scroll member into engagement with the fixed scroll may be located in a shoulder at the outer periphery of the orbiting scroll member or it may form the annular portion of an Oldham ring which controls the orbiting motion of the orbiting scroll member.

20 Claims, 5 Drawing Sheets

STABILIZATION RING AND SEAL CLEARANCE FOR A SCROLL COMPRESSOR

BACKGROUND OF THE INVENTION

1. Field of the Invention

The present invention relates generally to scroll compressors which include intermeshing fixed and orbiting scroll members and, more particularly, to mechanisms for biasing the orbiting scroll towards the fixed scroll.

2. Description of the Related Art

A typical scroll compressor comprises two facing scroll members, each having an involute wrap wherein the respective wraps interfit to define a plurality of closed compression pockets. When one of the scroll members is orbited relative to the other member, the pockets decrease in volume as they travel between a radially outer suction port and a radially inner discharge port. The pockets thereby convey and compress a fluid, typically a refrigerant, contained therein.

During compressor operation, the pressure of the compressed refrigerant tends to force the scroll members axially apart. Axial separation of the scroll members causes the closed pockets to leak at the interface between the wrap tips of one scroll member and the face surface of the other scroll member. Such leakage reduces the operating efficiency of the compressor and, in extreme cases, may result in the inability of the compressor to operate.

Undesirable leakage at the tip-to-face interface between scroll members can also be caused by a tilting or wobbling motion of the orbiting scroll member. This tilting motion is the result of overturning moments generated by forces acting on the orbiting scroll which are not symmetrical about the axis of the orbiting scroll. More specifically, the drive force imparted by the crankshaft to the drive hub of the orbiting scroll is spaced axially from forces acting on the scroll wrap due to pressure, inertia and friction. The overturning moment acting on the orbiting scroll member causes it to orbit in a slightly tilted condition so that the lower surface of the plate portion of the orbiting scroll is inclined upwardly in the direction of the orbiting motion. Wobbling motion of the orbiting scroll may result from the interaction between convex mating surfaces, particularly during the initial run-in period of the compressor. For instance, the mating wrap tip surface of one scroll member and face plate of the other scroll member may respectively exhibit convex shapes due to machining variations or pressure and heat distortion during compressor operation. This creates a contact point between the scroll members, about which the orbiting scroll has a tendency to wobble until the parts wear in. The wobbling perturbation occurs in addition to the tilted orbiting motion described above.

Efforts to counteract the separating force applied to the scroll members during compressor operation, and thereby minimize the aforementioned leakage, have resulted in the development of a variety of prior art axial compliance schemes. For example, it is known to axially preload the scroll members toward each other with a force sufficient to resist the dynamic separating force. Another approach is to assure close manufacturing tolerances for component parts and have the separating force borne by a thrust bearing or surface.

Pressurized gas or liquids may also be used to resist the separation forces which develop between the fixed and orbiting scroll members. In a compressor having a pressurized, or "high side", housing, discharge pressure has been used on the back side of the orbiting scroll member to create a compliance force to oppose the separating force. It is also known to use an intermediate pressure zone behind the orbiting scroll member or a combination of discharge pressure zones and suction pressure zones disposed behind different portions of the orbiting scroll whereby the pressure zones create a net upward force to oppose the separating force. Still another axial compliance mechanism for a scroll compressor involves exposing a radially inner portion of the orbiting scroll member bottom surface to oil at discharge pressure, and a radially outer portion to refrigerant fluid at suction pressure. Compressor designs utilizing a combination of pressure zones require the use of seal means engaging the bottom surface of the orbiting scroll member to separate the respective pressure zones.

Oftentimes such seal means comprise an O-ring seal disposed in a groove located in either the rear surface of the orbiting scroll member or in the bearing pad thrust surface. When the scroll compressor is not operating the pressure zones will assume a pressure equal to that of the surrounding atmosphere and the orbiting scroll will drop down into contact with the thrust surface. The movement of the orbiting scroll member may force the O-ring seal to be disposed entirely within the groove and thereby degrade its sealing ability. When the scroll compressor is once again started, the O-ring seal will remain disposed within the groove and have a reduced sealing capacity until the high pressure zone located radially inward of the O-ring seal lifts the orbiting scroll member off of the bearing pad and the O-ring seal drops partially out of the groove to more effectively engage both the thrust surface of the bearing pad and surfaces defining the groove on the rear of the orbiting scroll member.

An axial compliance mechanism which inhibits the tilt and wobble of the orbiting scroll member and improves the performance of sealing means located between the orbiting scroll and bearing pad is desired.

SUMMARY OF THE INVENTION

The present invention provides an improved axial compliance mechanism which resists the tendency of the scroll members to axially separate, wobble, and tilt during compressor operation while also improving the performance of a seal disposed between the rear surface of the orbiting scroll member and a bearing pad surface.

The present invention provides a scroll-type compressor including a fixed scroll member and an orbiting scroll member that are biased towards one another by an axial compliance mechanism which involves the application of a high pressure to a radially inner portion of the back surface of the orbiting scroll member and a relatively lower pressure to a radially outer portion of the back surface. An annular stabilization ring is placed between a main bearing pad and the rear surface of the orbiting scroll and lifts the orbiting scroll into engagement with the fixed scroll and and inhibits the tilting and wobbling of the orbiting scroll. The annular stabilization ring also maintains a clearance between the rear surface of the orbiting scroll and the main bearing pad, thereby improving the performance of a sealing member disposed between the main bearing pad and the rear surface of the orbiting scroll member during start up of the compressor.

In an alternative embodiment, the annular stabilization ring which lifts the scroll member into engagement with the fixed scroll forms the annular portion of an Oldham ring which controls the orbiting motion of the orbiting scroll member.

An advantage of a scroll compressor embodying the present invention is the provision of an axial compliance mechanism which resists axial separation of the scroll members caused by the separating forces and overturning moments acting on the orbiting scroll member.

Another advantage of the scroll compressor of the present invention is the enhanced performance, during start up of the scroll compressor, of the seal disposed between pressure zones acting on the rear surface of the orbiting scroll member thereby improving the efficiency of the scroll compressor.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
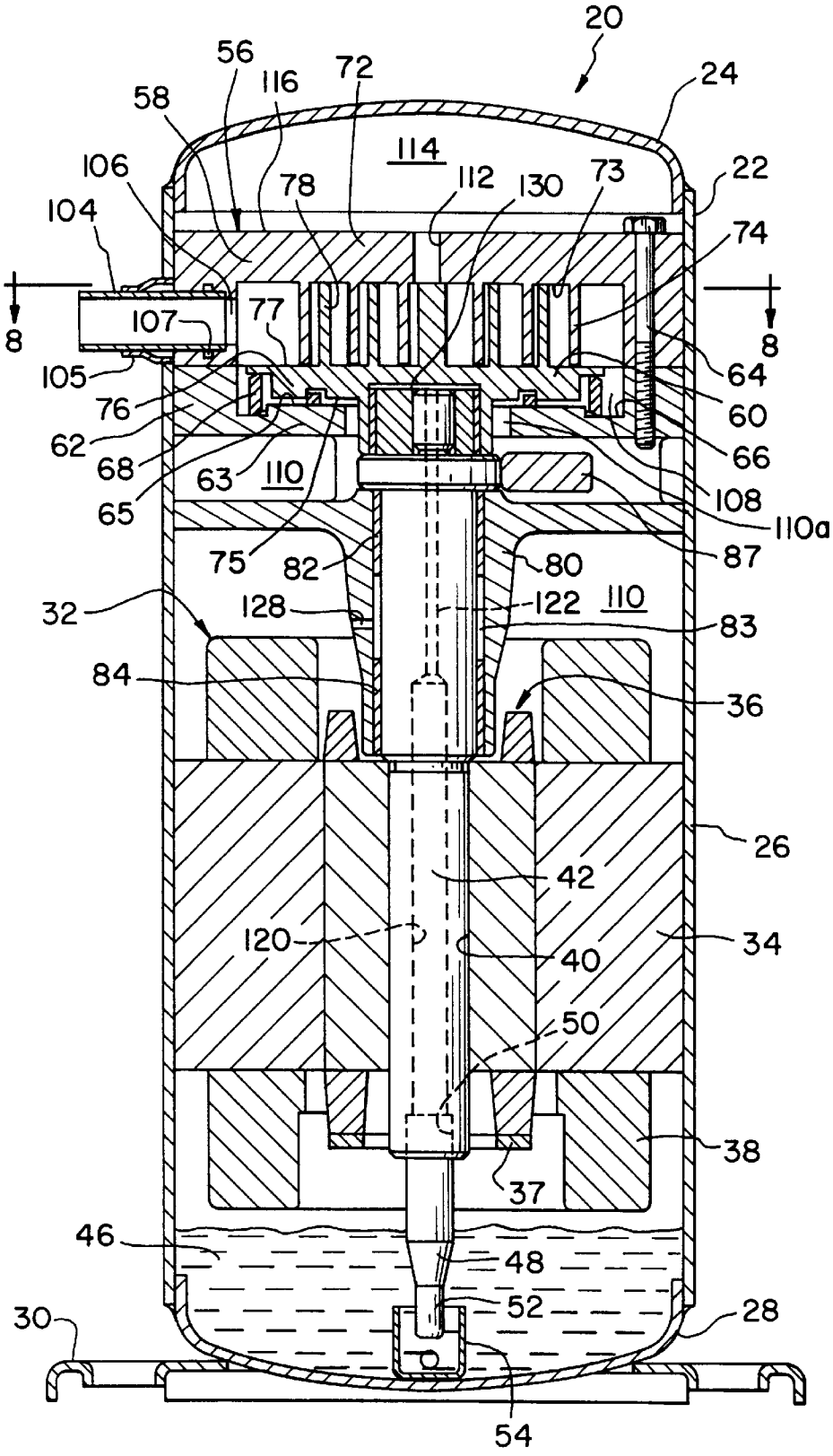
FIG. 1 is a cross sectional view of a scroll compressor having an axial compliance mechanism in accordance with the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention in several forms, however, such exemplifications are not to be construed as limiting the scope of the invention in any manner and the embodiments disclosed below are not intended to be exhaustive or limit the invention to the precise forms disclosed in the following detailed description.

DESCRIPTION OF THE PRESENT INVENTION

The present invention is described below utilizing the exemplary embodiment of a scroll compressor 20 shown in FIG. 1. It will be appreciated that the axial compliance mechanism and improved seal means of the present invention may be utilized in other scroll compressor designs as well as the exemplary scroll compressor shown in FIG. 1.

Scroll compressor 20 is shown having a housing generally designated at 22. The housing has a top cover portion 24, a central portion 26, and a bottom portion 28, wherein central portion 26 and bottom portion 28 may alternatively comprise a unitary shell member. The three housing portions are hermetically secured together as by welding or brazing. A mounting flange 30 is welded to bottom portion 28 for mounting the compressor in a vertically upright position. Located within hermetically sealed housing 22 is an electric motor generally designated at 32, having a stator 34 and a rotor 36. Stator 34 is secured within central portion 26 of the housing by an interference fit such as by shrink fitting, and is provided with windings 38. Rotor 36 has a central aperture 40 provided therein into which is secured a crankshaft 42 by an interference fit. The rotor also includes a counterweight 37 at the lower end ring thereof. A terminal cluster (not shown) is provided in central portion 26 of housing 22 for connecting motor 32 to a source of electric power.

Compressor 20 also includes an oil sump 46 generally located in bottom portion 28. A centrifugal oil pickup tube 48 is press fit into a counterbore 50 in the lower end of crankshaft 42. Oil pickup tube 48 is of conventional construction. An oil inlet end 52 of pickup tube 48 extends downwardly into the open end of a cylindrical oil cup 54, which provides a quiet zone from which high quality, non-agitated oil is drawn.

Scroll compressor mechanism 56 is enclosed within housing 22. Compressor mechanism 56 generally comprises a fixed scroll member 58, an orbiting scroll member 60, and a main bearing frame member 62. As shown in FIG. 1, fixed scroll member 58 and frame member 62 are secured together by means of a plurality of mounting bolts 64. Precise alignment between fixed scroll member 58 and main bearing frame member 62 is accomplished by a pair of locating pins (not shown). Main bearing frame member 62 is mounted within central portion 26 of housing 22 by means of a plurality of circumferentially disposed mounting pins (not shown) of the type shown and described in assignee's U.S. Pat. No. 4,846,635, the disclosure of which is hereby incorporated herein by reference. The mounting pins facilitate mounting of frame member 62 such that there is an annular gap between stator 34 and rotor 36.

Figure 8:
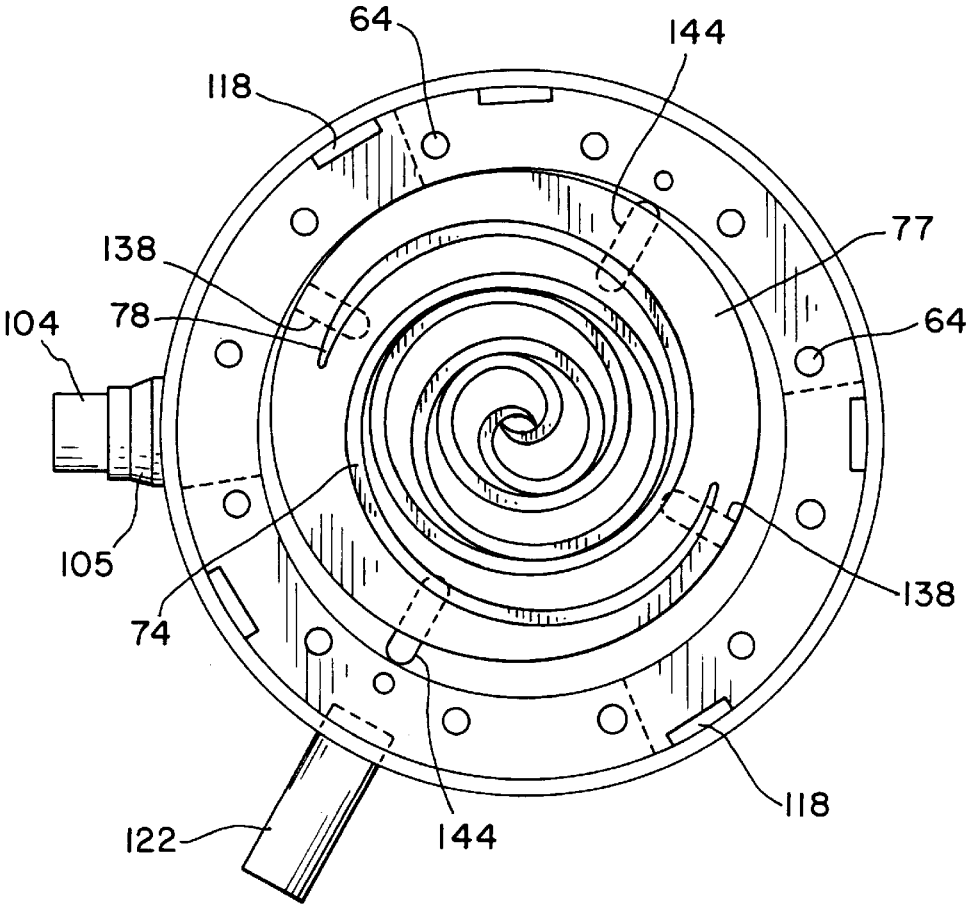
FIG. 8 is a cross sectional view of the scroll compressor of FIG. 1 taken along line 8—8.

Fixed scroll member 58 comprises a generally flat plate 72 having an interior plate surface 73, and an involute fixed wrap 74 extending axially from surface 73. Likewise, orbiting scroll member 60 comprises a generally flat plate 76 having a rear surface 75 (FIG. 3), an interior plate surface 77, and an involute orbiting wrap 78 extending axially from surface 77. Fixed scroll member 58 and orbiting scroll member 60 are assembled together so that fixed wrap 74 and orbiting wrap 78 operatively interfit with each other as can be seen in FIG. 8. Furthermore, surfaces 73, 77 and wraps 74, 78 are manufactured or machined such that, when the fixed and orbiting scroll members are forced axially toward one another, the tips of wraps 74, 78 sealingly engage with respective opposite face surfaces 77, 73.

Main bearing frame member 62 includes an annular, inner pad 63, including an axially facing stationary sealing surface 65 adjacent rear surface 75 and in opposing relationship thereto. Rear surface 75 and sealing surface 65 lie in substantially parallel planes and are axially spaced. Main bearing frame member 62 further comprises a recessed bearing surface 66.

Retained within bearing portion 80, as by press fitting, is a conventional sleeve bearing assembly comprising an upper bearing 82 and a lower bearing 84. The use of two sleeve bearings, rather than a single longer sleeve bearing, facilitates easy assembly into bearing portion 80 and provides an annular space 83 between the two bearings 82, 84. Accordingly, crankshaft 42 is rotatably journalled within bearings 82, 84.

Figure 2:
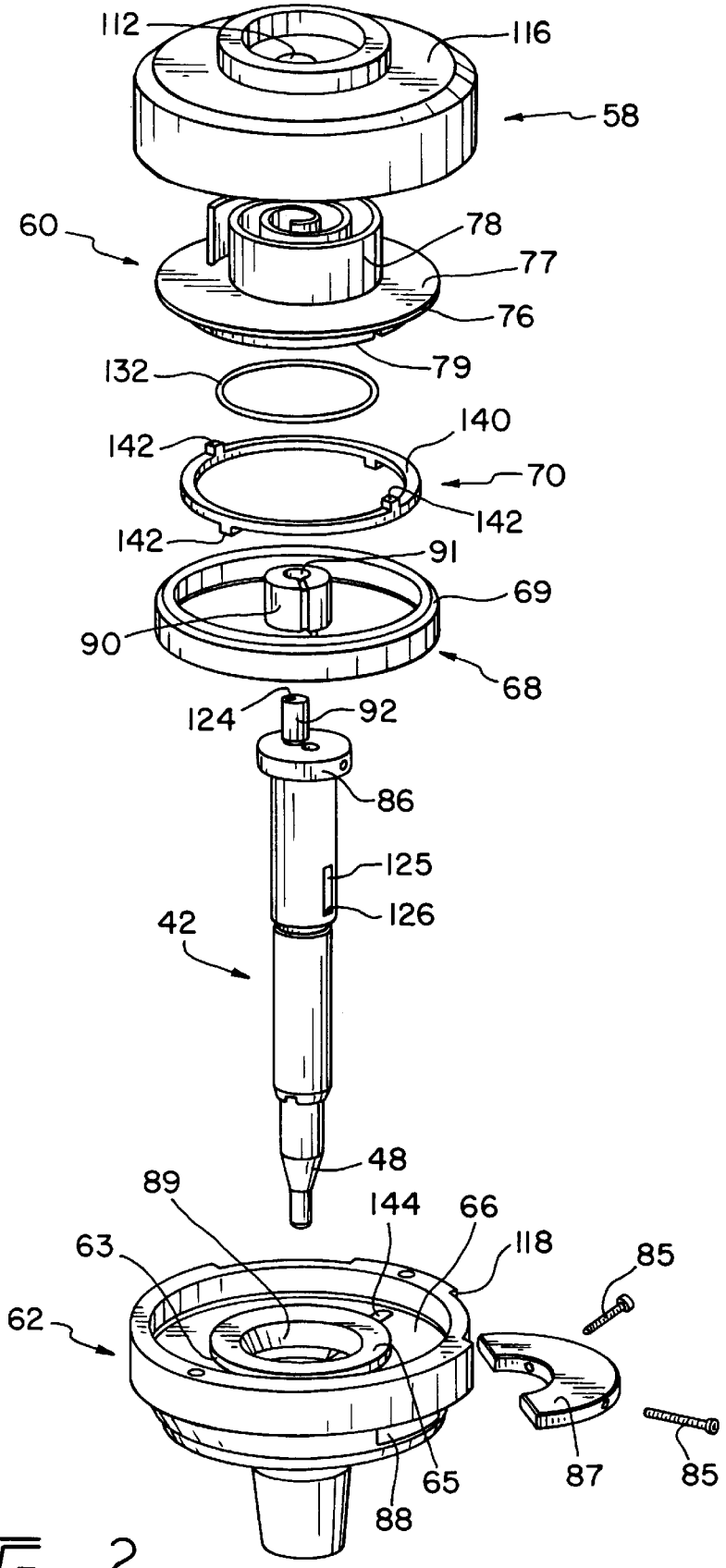
FIG. 2 is an exploded view of a portion of the scroll compressor of FIG. 1.

As seen in FIG. 2, crankshaft 42 includes a concentric thrust plate 86 extending radially outwardly from the sidewall of crankshaft 42. A balance weight 87 is attached to thrust plate 86, as by bolts 85. In the embodiment disclosed herein, the diameter of thrust plate 86 is less than the diameter of a round opening 89 defined by pad 63, whereby crankshaft 42 may be inserted downwardly through opening 89. Once crankshaft 42 is in place, balance weight 87 is attached thereto through one of a pair of radially extending mounting holes 88. These mounting holes also interconnect the space surrounding thrust plate 86 via axially extending passages 118 formed in the outer periphery of main bearing frame 62 with the discharge plenum chamber 114 and that portion of the housing chamber 110 which is at a discharge pressure.

Figure 3:
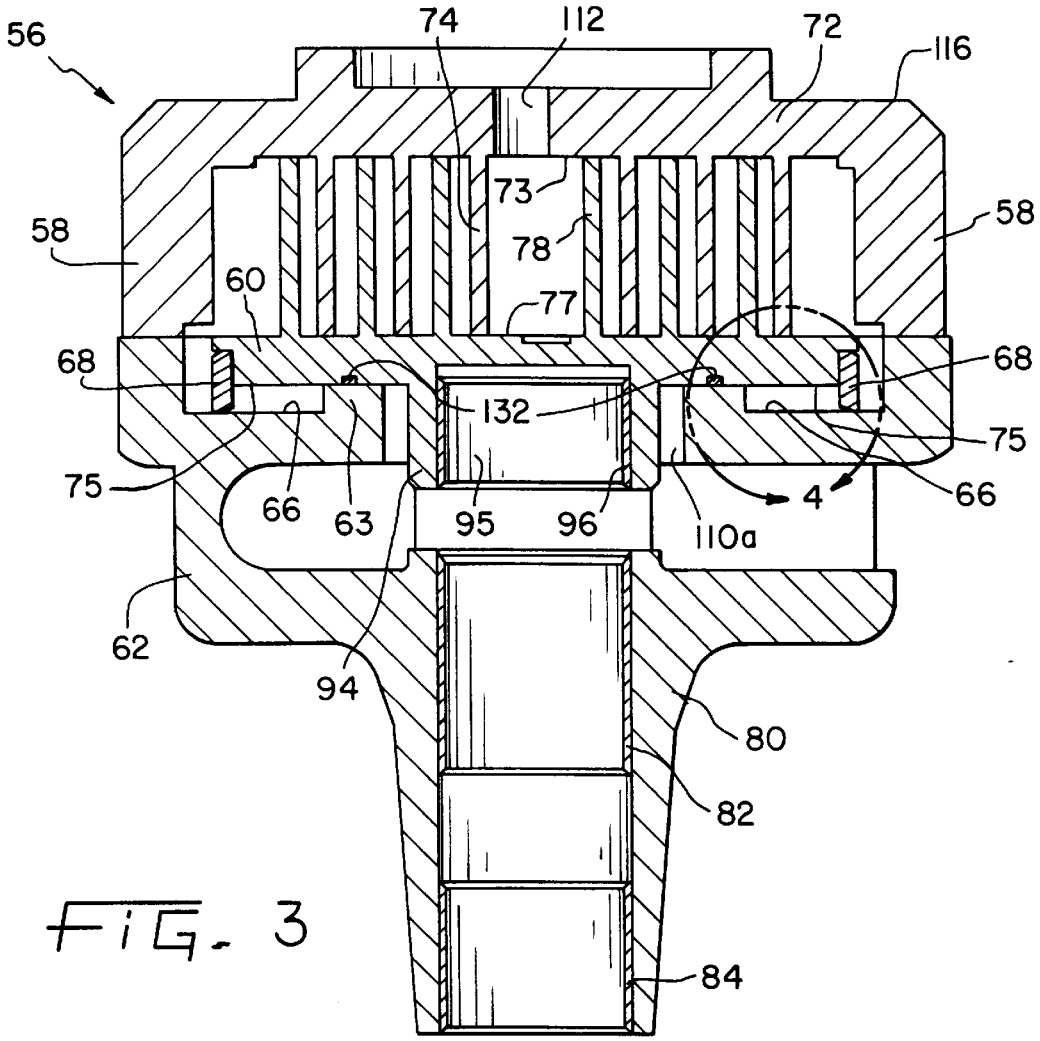
FIG. 3 is an enlarged cross sectional view of a portion of the scroll compressor of FIG. 1.
Figure 5:
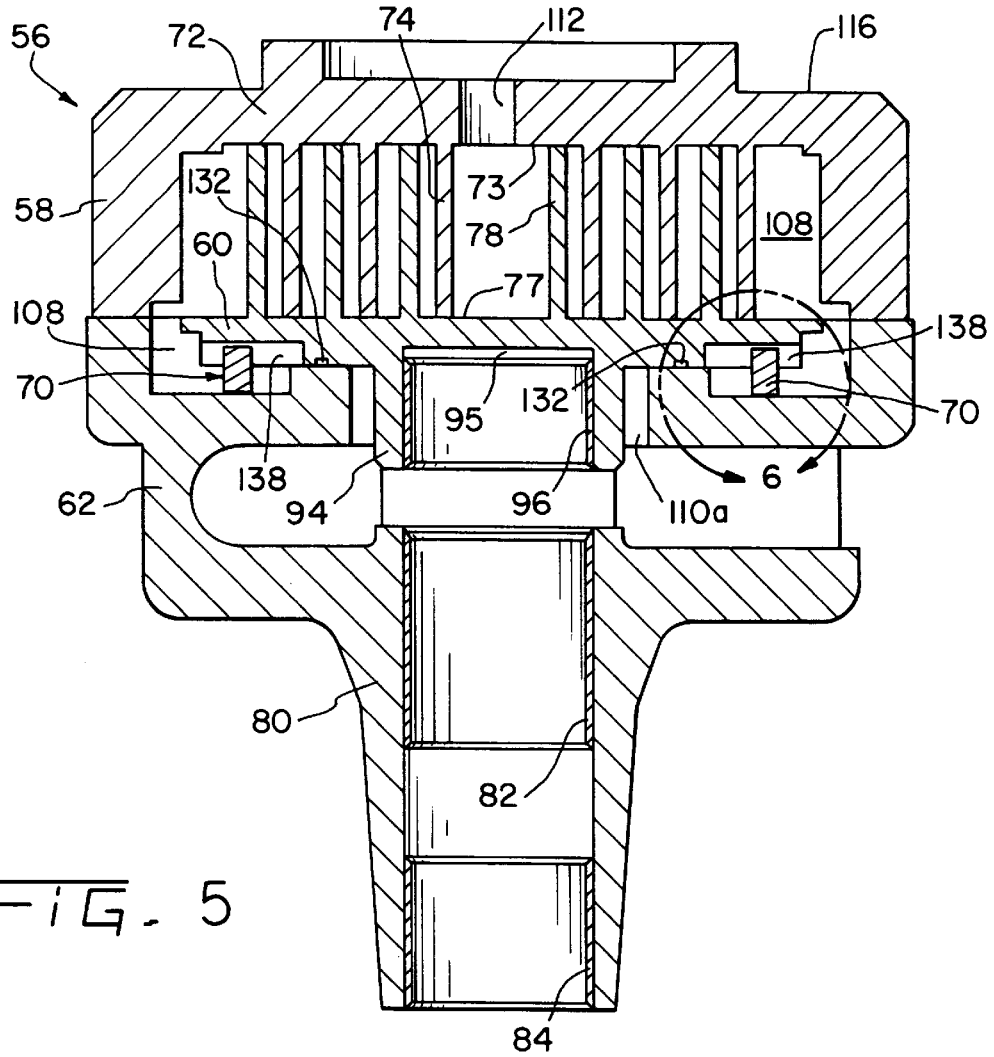
FIG. 5 is a cross sectional view of a second embodiment of the invention.

An eccentric crank mechanism is situated on the top of crankshaft 42, as shown in the exploded view of FIG. 2. According to the illustrated embodiment, the crank mechanism comprises a cylindrical roller 90 having an axial bore 91 extending therethrough at an off-center location. An eccentric crankpin 92, constituting the upper, offset portion of crankshaft 42, is received within bore 91, whereby roller 90 is eccentrically journalled about eccentric crankpin 92. As seen in FIGS. 3 and 5, orbiting scroll member 60 includes a lower hub portion 94 that defines a cylindrical well 95 into which roller 90 is received. Roller 90 is journalled for rotation within well 95 by means of a sleeve bearing 96, which is press fit into well 95. Each of sleeve bearings 82, 84, and 96 is a steel-backed bronze bushing.

When crankshaft 42 is rotated by motor 32, the operation of eccentric crankpin 92 and roller 90 within well 95 causes orbiting scroll member 60 to orbit with respect to fixed scroll member 58. Roller 90 pivots slightly about crankpin 92 so that the crank mechanism functions as a conventional swing-link radial compliance mechanism to promote sealing engagement between fixed wrap 74 and orbiting wrap 78. Orbiting scroll member 60 is prevented from rotating about its own axis by means of an Oldham ring assembly discussed in greater detail below.

In operation of compressor 20 refrigerant fluid at suction pressure is introduced through a suction tube 104, which is sealingly received within a counterbore 106 in fixed scroll member 58 with the aid of an O-ring seal 107. Suction tube 104 is secured to the compressor by means of a suction tube adaptor 105 that is silver soldered or brazed to both the suction tube and an opening in the housing. A suction pressure chamber 108 is generally defined by fixed scroll member 58 and frame member 62 and extends behind an outer peripheral portion of the rear surface 75 of the orbiting scroll member 60. Refrigerant is introduced into chamber 108 from suction tube 104 at a radially outer location thereof. As orbiting scroll member 60 is caused to orbit, refrigerant fluid within suction pressure chamber 108 is compressed radially inwardly by moving closed pockets defined by fixed wrap 74 and orbiting wrap 78.

Refrigerant fluid at discharge pressure in the innermost pocket between the wraps is discharged upwardly through a discharge port 112 communicating through plate 72 of fixed scroll member 58. Compressed refrigerant discharged through port 112 enters a discharge plenum chamber 114 defined by top cover portion 24 and top surface 116 of fixed scroll member 58. Axially extending passages 118, shown in FIGS. 2 and 8, allow the compressed refrigerant in discharge plenum chamber 114 to be introduced into housing chamber 110 defined within housing 22. As shown in FIG. 8, a discharge tube 122 extends through central portion 26 of housing 22 and is sealed using silver solder. Discharge tube 122 allows pressurized refrigerant within housing chamber 110 to be delivered to the refrigeration system (not shown) in which compressor 20 is incorporated.

Compressor 20 also includes a lubrication system for lubricating the moving parts of the compressor, including the scroll members, crankshaft, and crank mechanism. An axial oil passageway 120 is provided in crankshaft 42, which communicates with tube 48 and extends upwardly along the central axis of crankshaft 42. At a central location along the length of crankshaft 42, an offset, radially divergent oil passageway 122 intersects passageway 120 and extends to an opening 124 on the top of eccentric crankpin 92 at the top of crankshaft 42. As crankshaft 42 rotates, oil pickup tube 48 draws lubricating oil from oil sump 46 and causes oil to move upwardly through oil passageways 120 and 122. Lubrication of upper bearing 82 and lower bearing 84 is accomplished by means of flats 125 formed in crankshaft 42, located in the general vicinity of bearings 82 and 84, and communicating with oil passageways 120 and 122 by means of radial passages 126 (FIG 2). A vent passage 128 (FIG 1) extends through bearing portion 80 to provide communication between annular space 83 and discharge pressure chamber 110.

Lubricating oil pumped upwardly through offset oil passageway 122 exits crankshaft 42 through oil passageway 122 which has an opening 124 located on the top of eccentric crankpin 92. Lubricating oil delivered from passageway 122 fills a chamber 130 within well 95, defined by the interior surface of well 95 and the top surfaces of roller 90 and crankpin 92. Oil within chamber 130 tends to flow downwardly along the interface between roller 90 and sleeve bearing 96, and the interface between bore 91 and crankpin 92, for lubrication thereof. A flat (not shown) may be provided in the outer cylindrical surfaces of roller 90 and crankpin 92 to enhance lubrication.

The lubricating oil provided by the aforementioned lubrication system to the central portion of the underside of orbiting scroll member 60 within well 95 is at discharge pressure. Accordingly, when the lubricating oil fills chamber 130, an upward force acts upon orbiting scroll member 60 toward fixed scroll member 58. The magnitude of this upward force, determined by the surface area of the bottom or end surface of well 95, is insufficient to provide the necessary axial compliance force. Therefore, in order to increase the upward force on orbiting scroll member 60, an annular portion of rear surface 75 immediately adjacent, i.e., circumjacent, hub portion 94 is exposed to refrigerant fluid at discharge pressure.

Figure 4:
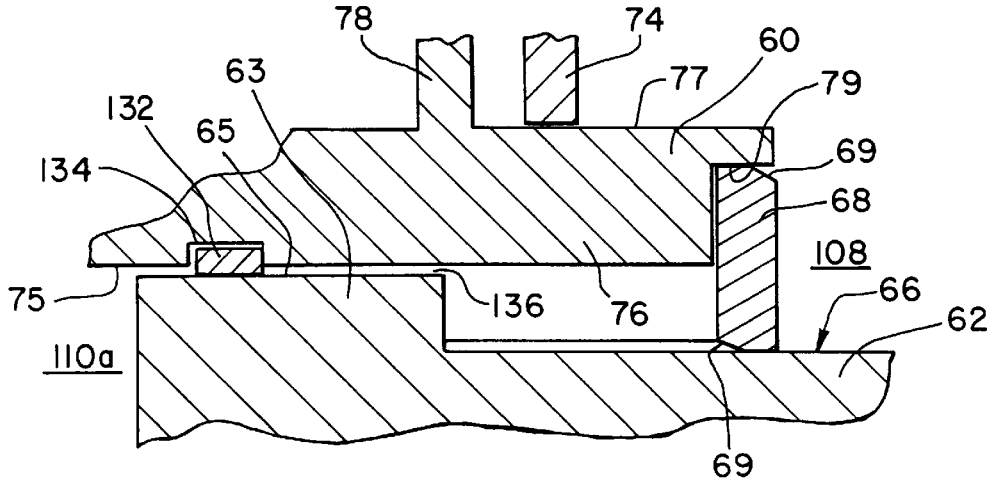
FIG. 4 is an enlarged view of the circled area of FIG. 3.

As best seen in FIG. 4, an annular seal 132 is unattachedly disposed in a circular groove 134 concentrically disposed in rear surface 75 of the orbiting scroll member 60. The annular seal 132 is formed of an elastomeric material and may be composed of a Teflon material. More specifically, a glass filled Teflon, or a mixture of Teflon, carbon and Ryton may be used to form the annular seal 132. Other suitable materials, however, may also be used to form annular seal 132.

Annular seal 132 separates suction pressure zone 108 from a discharge pressure zone 110*a* by sealingly engaging the orbiting scroll member 60 at groove 134 and sealing surface 65 disposed on the inner pad 63 of main bearing frame member 62. Because pressure zone 110*a* is at a higher pressure than pressure zone 108, annular seal 132 is forced downward into engagement with sealing surface 65 and outward into engagement with the radially outermost surface of groove 134 by the pressurized fluid in pressure zone 110*a* as most clearly seen in FIGS. 4 and 6.

Cast iron is used to form bearing frame member 62 and orbiting scroll 60 and, thus, the surfaces engaged by annular seal 132 are cast iron surfaces. Alternative materials, however, may also be used to form the main bearing frame member 62 and orbiting scroll 60.

The annular seal 132 sealingly separates the suction pressure chamber 108 from the high pressure zone 110*a* circumjacent hub 94. High pressure zone 110*a* is interconnected via round opening 89 (FIG 2) to the housing chamber 110 and, during operation of the compressor, contains refrigerant fluid at the discharge pressure. Because the groove 134 is located in the rear of the orbiting scroll member 60 rather than the sealing surface 65 of the pad 63, fixed portions of the rear surface 75 radially inside and radially outside annular seal 132 are exposed to discharge and suction pressure, respectively, as orbiting scroll member 60 moves in an orbiting motion with respect to both fixed scroll member 58 and pad 63. The orbiting scroll member 60 is therefore subjected to a substantially constant pressure distribution acting upwardly on orbiting scroll member 60 toward fixed scroll member 58. The substantially constant pressure distribution on rear surface 75 reduces the magnitude of the moments about the central axis of orbiting scroll member 60 during operation of compressor 20.

Although the annular seal 132 sealingly separates the suction pressure chamber 108 from the high pressure zone 110*a* in the disclosed compressor, alternative designs are also possible. For example, an alternative design could utilize seal 132 to separate a discharge pressure zone from an intermediate pressure zone disposed adjacent the rear of orbiting scroll member 60.

Refrigerant fluid is compressed for discharge into housing chamber 110 by operation of the compressor 20. As housing chamber 110 becomes pressurized, the oil within chamber 130 and the fluid within pressure zone 110*a* also become pressurized and exert an upwardly directed biasing force on orbiting scroll member 60. When the compressor 20 is not operating, chamber 130 and pressure zone 110*a* return to atmospheric pressure. When the compressor 20 is once again actuated, chamber 130 and pressure zone 110*a* become pressurized again. During the start-up of the compressor 20, however, chamber 130 and pressure zone 110*a* are initially at atmospheric pressure and require a short period of time to become fully pressurized by the operation of the scroll compressor 20. During this start-up period, the fluids in chamber 130 and pressure zone 110*a* are not yet at the discharge pressure and, thus, exert less of an upwardly biasing force on the orbiting scroll member 60 than during normal operations.

The upward biasing force on orbiting scroll member 60 exerted by the pressurized fluid in pressure zone 110*a* and by the pressurized oil in chamber 130 bias the tips of wraps 74, 78 against the respective interior surface 77,73 of the opposite scroll member. The wrap tips and opposing interior surface must be sealingly engaged during operation of the scroll compressor to prevent the escape of fluid being compressed inside the pockets formed by the interfitting of the wraps 74, 78. Failure to effectively seal the wrap tip/interior surface interface results in less efficient operation or, in extreme cases, inoperability of the scroll compressor 20. The axial biasing of the orbiting scroll member 60 to maintain the tips of wraps 74, 78 in sealing engagement is typically reduced during start-up of the compressor 20 because the reduced pressure of the fluids in pressure zone 110*a* and chamber 138 provides less of an axially biasing force than during normal operation of the scroll compressor 20.

In many scroll compressor designs, the effects of the reduced axial biasing force during start-up are compounded because the axial position of the orbiting scroll member during start-up of the scroll reduces the effectiveness of the seal element disposed between the high pressure and low pressure zones located behind the rear of the orbiting scroll. When the scroll compressor is inactive, the orbiting scroll member assumes an at rest position in which, in many prior art designs, the orbiting scroll member is supported by the inner pad of the main bearing frame member with the seal either supporting the orbiting scroll member slightly above the pad or being entirely compressed within the groove on the rear of the orbiting scroll member. As the compressor begins to operate, the orbiting scroll member is axially lifted into further engagement with the fixed scroll due to the build-up of pressure behind the orbiting scroll member. After sufficient pressure has been produced, the orbiting scroll member is no longer supported, directly or indirectly, by the inner pad of the main bearing frame member and is supported entirely by the pressurized fluids.

During the start-up period of the compressor the orbiting scroll member is subjected to axial movement as it progresses from its at rest position to its fully engaged position. The seal element disposed in a groove in the rear surface of the orbiting scroll member is generally less effective during this start up period than during normal operation of the scroll compressor due to the axial movement of the orbiting scroll.

The present invention improves the performance of seal 132 during the start-up of the compressor 20 and simultaneously provides a mechanism for reducing the wobble and tilt of the orbiting scroll by placing an annular ring having controlled dimensions between the rear surface 75 of orbiting scroll member 60 and the recessed bearing surface 66 of main bearing frame member 62. The annular ring thereby lifts the orbiting scroll 60 off the inner pad 63 and prevents the orbiting scroll from disengaging from the fixed scroll when the pressure behind the orbiting scroll is diminished. The annular ring may take various forms and a stabilization ring 68 and stabilization/Oldham ring 70 are discussed below.

As shown most clearly in FIGS. 3 and 4, stabilization ring 68 has a substantially rectangular cross section with small angular surfaces 69 located at diagonally opposite cross sectional corners of stabilization ring 68. Stabilization ring 68 is disposed in a recessed shoulder 79 located on the lower, outer periphery of the flat plate 76 of orbiting scroll member 60 and bears against the recessed bearing surface 66 of the main bearing frame member 62 and shoulder 79. Stabilization ring 68 travels with the orbiting scroll member 60 as it orbits the fixed scroll member 58 and, thus, stabilization ring 68 is in sliding engagement with recessed bearing surface 66. The stabilization ring biases the orbiting scroll member into engagement with the fixed scroll member and thereby maintains a clearance space 136 between the rear surface 75 of the orbiting scroll member 60 and the sealing surface 65 of the inner pad 63 of the main bearing frame member 62. The biasing of the orbiting scroll member 60 towards the fixed scroll member 58 forces the tips of wraps 78, 74 into sealing engagement with respective interior surfaces 73, 77 and reduces the wobble and tilt of the orbiting scroll member 60 by limiting the axial movement of the outer periphery of the orbiting scroll member 60.

Stabilization ring 68 biases the orbiting scroll member 60 upwards into engagement with fixed scroll member 58 at all times, including start up periods and when the compressor is inactive. Stabilization ring 68 thereby limits the tilt and wobble of the orbiting scroll member 60 when the scroll compressor 20 is activated and also improves the efficiency of the scroll compressor 20 during the start-up period. The stabilization ring 68 provides for a more efficient start-up period by maintaining the engagement of the wrap tips and interior surfaces of the respective scroll members and improving the effectiveness of annular seal 132.

The stabilization ring 68 improves the effectiveness of seal 132 during the start up period by limiting the axial movement of the orbiting scroll member 60 and maintaining a clearance 136 between sealing surface 65 and rear surface 75.

Figure 6:
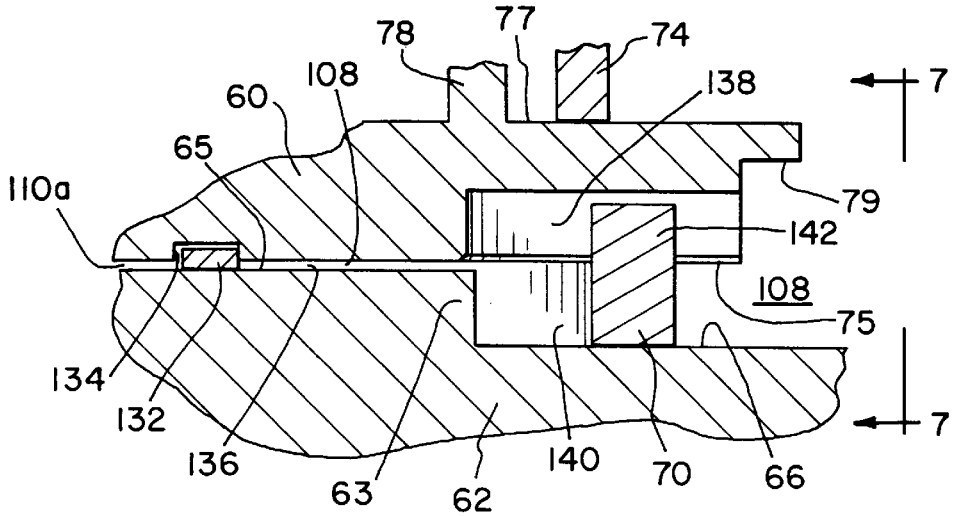
FIG. 6 is an enlarged view of the circled area of FIG. 5.

In prior art designs where the orbiting scroll member was lifted into engagement with the fixed scroll member by pressure acting on the rear surface of the orbiting scroll, the axial movement of the orbiting scroll created a gap between the inner pad and the rear surface of the orbiting scroll member which increased in size as the orbiting scroll was axially moved into engagement with the fixed scroll. A seal located in a groove in the rear of the orbiting scroll member in such prior art designs had to move downwardly under the influence of gravity, pressure differentials and/or a venturi effect caused by a flow of fluid from the radially inward high pressure zone to the radial exterior low pressure zone to maintain a proper seal. The stabilization ring 68 of the present invention, however, restricts the axial movement of the orbiting scroll member 60 thereby preventing the orbiting scroll member 60 from bearing on inner pad 63 and maintaining clearance 136. As seen in FIGS. 4 and 6, the thickness of annular seal 132 is greater than clearance 136 but is less than the sum of clearance 136 and the depth of groove 134. Thus, by maintaining clearance 136, the annular seal 132 is loose within groove 134 when the scroll compressor 20 is not operating and is not forced entirely within groove 134 by the weight of orbiting scroll member 60. In the preferred embodiment clearance 136 is about 0.0055 inches with annular seal 132 having a thickness of about 0.047 inches and groove 134 having a depth of about 0.040 inches. Although clearance 136 is preferably about 0.0055 inches, the performance of annular seal 132 will still be enhanced when clearance 136 is between about 0.0005 and 0.0105 inches, and clearance 136 will still function adequately with annular seal 132 so long as clearance 136 does not exceed about 0.015 inches.

During the start-up of compressor 20, the orbiting scroll member 60 is already lifted into engagement with the fixed scroll member 58 by stabilization ring 68 and, thus, seal 132 does not have to drop from engagement with the upper surface of groove 134 during axial movement of orbiting scroll member 60 and is advantageously positioned to provide an effective seal upon actuation of scroll compressor 20. As a pressure gradient between suction pressure chamber 108 and chamber 110*a* develops during the start up of scroll compressor 20, seal 132 is rapidly forced downward into sealing engagement with sealing surface 65 and radially outward into sealing engagement with a radially exterior wall of groove 134. Rapidly providing an effective seal between pressure zones 110*a* and 108 minimizes the loss of pressure within chamber 110*a* during the start up of scroll compressor 20 and enhances the efficiency of scroll compressor 20.

Figure 7:
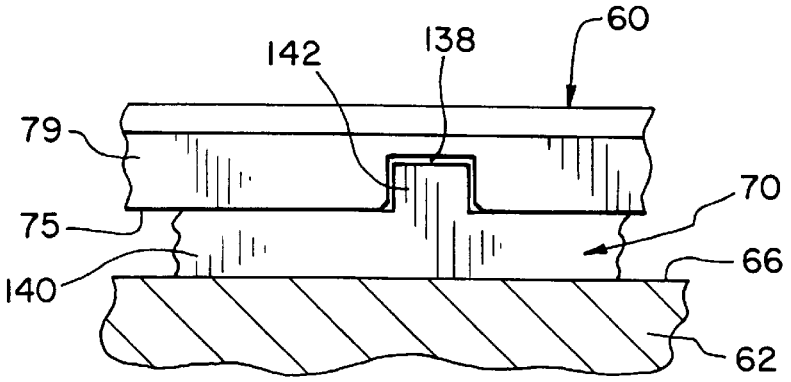
FIG. 7 is a view taken along line 7—7 of FIG. 6.

As shown in FIGS. 5, 6 and 7, a stabilization/Oldham ring 70 can be used instead of stabilization ring 68 to bias the orbiting scroll member 60 into engagement with the fixed scroll member 58 and maintain clearance 136. The illustrated Oldham ring 70 includes a controlled thickness annular ring 140 and projecting keys 142. The controlled thickness annular ring element 140 is disposed between recessed bearing surface 66 and rear surface 75 of orbiting scroll member 60. Annular ring element 140 biases orbiting scroll member 60 into engagement with fixed scroll member 58, maintains clearance 136 and reduces the tilt and wobble of orbiting scroll member 60 in a manner similar to that of stabilization ring 68.

Both stabilization ring 68 and Oldham ring 70 form sliding members, however, unlike stabilization ring 68 which is in sliding engagement with recessed surface 66, Oldham ring 70 is not disposed in recessed shoulder 79 and is, instead, in sliding engagement with both rear surface 75 and recessed surface 66. Thus, annular ring 140 of Oldham ring 70 engages rear surface 75 of orbiting scroll member 60 at locations radially inward of recessed shoulder 79. Additionally, the locations at which annular ring 140 engages rear surface 75 change as the orbiting scroll member 60 orbits relative to fixed scroll member 58 and are not necessarily centered about the axis of orbiting scroll member 60. Thus, although annular ring 140 functions in a manner similar to stabilization ring 68 by biasing orbiting scroll member 60 into engagement with fixed scroll member 58, stabilization ring 68 more effectively limits the wobble and tilt of orbiting scroll member 60 because of its positioning at the exterior periphery of orbiting scroll member 60.

Oldham ring 70 has projecting keys 142 forming two pairs of keys located on opposite sides of Oldham ring 70 and disposed at a 90° angle. Projecting keys 142 engage keyways 138, 144 disposed respectively in rear surface 75 and bearing surface 66 to thereby cause orbiting scroll member 60 to orbit fixed scroll member 58 without permitting orbiting scroll member 60 to rotate about its center point. When stabilization ring 68 is utilized rather than Oldham/stabilization ring 70, an anti-rotation mechanism is required in addition to stabilization ring 68 to prevent orbiting scroll member 60 from rotating about its axis as it orbits the fixed scroll member 58. In FIG. 2, an Oldham/stabilization ring is shown in the same scroll compressor as a stabilization ring 68 for purposes of illustrating the interrelationship of the various components which may comprise scroll compressor 20. Although an Oldham ring with a controlled thickness annular ring 140 could be utilized when manufacturing a scroll compressor 20 having a stabilization ring 68, it would be more cost-effective to use a conventional Oldham ring without a controlled thickness annular ring, in combination with stabilization ring 68, to prevent the rotation of orbiting scroll member 60. When an Oldham ring 70 having a controlled thickness annular ring 140 is utilized, however, stabilization ring 68 can be omitted entirely.

In addition to the illustrated keys and keyways, it would also be possible to use other anti-rotation means in conjunction with annular ring 140 or stabilization ring 68 to prevent rotation of the orbiting scroll member 60. For example, it would be possible to reverse the positions of the keyways and projecting keys whereby controlled thickness annular ring 140, or a ring having larger tolerances and used in conjunction with stabilization ring 68, had four keyways which engaged keys projecting from rear surface 75 and bearing surface 66 to prevent rotation of the orbiting scroll member 60.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains. Accordingly, the scope of the invention should be determined not by the illustrated embodiments but by the following claims and their legal equivalents.

What is claimed is:

1. An axial compliance mechanism for a scroll compressor, said axial compliance mechanism comprising:

a fixed scroll member having a fixed plate portion and an involute fixed wrap element;

an orbiting scroll member having an orbiting plate portion with a first orbiting surface and a second orbiting surface, said second surface being disposed opposite said first surface and substantially parallel to said first surface, said first orbiting surface having an involute orbiting wrap element extending therefrom, said orbiting wrap element being intermeshed with said fixed wrap element;

a bearing pad spatially fixed in relationship to said fixed scroll member and having a sealing surface adjacently spaced from said second orbiting surface;

a seal means disposed between said second orbiting surface and said sealing surface, said seal means sealingly separating a radially inward region containing a first fluid contacting said second surface and a radially outward region containing a second fluid contacting said second surface; and an annular stabilization ring disposed between said bearing pad and said second orbiting surface, said annular stabilization ring in engaging contact with said bearing pad and said second orbiting surface, axial separation of said orbiting and fixed scroll members inhibited by said annular stabilization ring, a clearance between said second orbiting surface and said sealing surface maintained by said annular stabilization ring.

2. The axial compliance mechanism of claim 1 wherein said annular stabilization ring is disposed radially outward of said seal means.

3. The axial compliance mechanism of claim 2 wherein said second orbiting surface includes a recess forming a shoulder at an outer periphery of said orbiting plate portion and said annular stabilization ring is partially disposed within said recess.

4. The axial compliance mechanism of claim 1 wherein said second orbiting surface further comprises an annular groove and said seal means comprises an annular seal partially disposed within said groove.

5. The axial compliance mechanism of claim 4 wherein said first fluid has a higher pressure than said second fluid.

6. The axial compliance mechanism of claim 4 wherein a sum of said clearance and a depth of said groove is greater than a thickness of said seal whereby said clearance provided by said annular stabilization ring prevents said orbiting scroll from bearing on said annular seal.

7. The axial compliance mechanism of claim 1 wherein said bearing pad has a bearing surface for engaging said annular stabilization ring, said bearing surface is parallel to said sealing surface and is disposed at a greater distance from said second orbiting surface than said sealing surface.

8. The axial compliance mechanism of claim 1 wherein said annular ring further comprises a plurality of projecting keys; said second orbiting surface further comprises a slot for receiving at least one of said projecting keys; and said bearing pad further comprises a slot for receiving at least one of said projecting keys whereby rotation of said orbiting scroll relative to said fixed scroll is inhibited.

9. The axial compliance mechanism of claim 8 wherein said annular stabilization ring is disposed radially outward of said seal means.

10. The axial compliance mechanism of claim 8 wherein said second orbiting surface further comprises an annular groove and said seal means comprises an annular seal partially disposed within said groove.

11. The axial compliance mechanism of claim 10 wherein said first fluid has a higher pressure than said second fluid.

12. The axial compliance mechanism of claim 10 wherein a sum of said clearance and a depth of said groove is greater than a thickness of said seal whereby said clearance provided by said annular stabilization ring prevents said orbiting scroll from bearing on said annular seal.

13. The axial compliance mechanism of claim 8 wherein said bearing pad has a bearing surface for engaging said annular stabilization ring, said bearing surface is parallel to said sealing surface and is disposed at a greater distance from said second orbiting surface than said sealing surface.

14. The axial compliance mechanism of claim 1 wherein said stabilization ring further comprises anti-rotation means for preventing rotation of said orbiting scroll member relative to said fixed scroll member.

15. An axial compliance mechanism for a scroll compressor, said axial compliance mechanism comprising:

a fixed scroll member having a fixed plate portion and an involute fixed wrap element;

an orbiting scroll member having an orbiting plate portion with a first orbiting surface and a second orbiting surface, said second surface being disposed opposite said first surface and substantially parallel to said first surface, said first orbiting surface having an involute orbiting wrap element extending therefrom, said orbiting wrap element being intermeshed with said fixed wrap element;

a bearing pad spatially fixed in relationship to said fixed scroll member and having a sealing surface disposed adjacent said second orbiting surface;

a seal means disposed between said second orbiting surface and said sealing surface, said seal means sealingly separating a radially inward region containing a first fluid contacting said second surface and a radially outward region containing a second fluid contacting said second surface; and a sliding member having a controlled thickness, said sliding member disposed between said bearing pad and said second orbiting surface, said sliding member in engaging contact with said bearing pad and said second orbiting surface, axial separation of said orbiting and fixed scroll members inhibited by said sliding member, a clearance between said second orbiting surface and said sealing surface maintained by said sliding member.

16. The axial compliance mechanism of claim 15 wherein said sliding member has a substantially circular shape.

17. The axial compliance mechanism of claim 15 wherein said sliding member is disposed near an outer periphery of said orbiting member and radially outwardly of said seal means.

18. The axial compliance mechanism of claim 15 wherein said second orbiting surface further comprises an annular groove and said seal means comprises an annular seal partially disposed within said groove.

19. The axial compliance mechanism of claim 15 wherein said sliding member further comprises anti-rotation means for preventing rotation of said orbiting scroll member relative to said fixed scroll member.

20. The axial compliance mechanism of claim 15 wherein said sliding member further comprises a plurality of projecting keys; said second orbiting surface further comprises a slot for receiving at least one of said projecting keys; and said bearing pad further comprises a slot for receiving at least one of said projecting keys whereby rotation of said orbiting scroll relative to said fixed scroll is inhibited.

* * * * *